US012631366B2

(12) United States Patent
Ng et al.

(10) Patent No.: US 12,631,366 B2
(45) Date of Patent: May 19, 2026

(54) MOUNTING STRUCTURE OF A GRILLE

(71) Applicant: DAIKIN RESEARCH & DEVELOPMENT MALAYSIA SDN. BHD., Sungai Buloh (MY)

(72) Inventors: Wei Tat Ng, Sungai Buloh (MY); Zi Yong Tean, Sungai Buloh (MY)

(73) Assignee: DAIKIN RESEARCH & DEVELOPMENT MALAYSIA SDN. BHD., Sungai Buloh (MY)

( * ) Notice: Subject to any disclaimer, the term of this patent is extended or adjusted under 35 U.S.C. 154(b) by 567 days.

(21) Appl. No.: 17/792,861

(22) PCT Filed: Jan. 18, 2021

(86) PCT No.: PCT/MY2021/050002
§ 371 (c)(1),
(2) Date: Jul. 14, 2022

(87) PCT Pub. No.: WO2021/150100
PCT Pub. Date: Jul. 29, 2021

(65) Prior Publication Data

US 2023/0048227 A1 Feb. 16, 2023

(30) Foreign Application Priority Data

Jan. 22, 2020 (MY) ..... PI2020000361

(51) Int. Cl.
*F24F 13/08* (2006.01)
*F04D 29/70* (2006.01)
(Continued)

(52) U.S. Cl.
CPC ..... *F24F 13/084* (2013.01); *F04D 29/703* (2013.01); *F24F 1/56* (2013.01); *F24F 13/20* (2013.01); *F24F 2221/17* (2013.01)

(58) Field of Classification Search
CPC .. F24F 13/084; F24F 13/20; F24F 1/56; F24F 2221/17; F24F 2013/207; F24F 2221/32;
(Continued)

(56) References Cited

U.S. PATENT DOCUMENTS 4,261,418 A * 4/1981 Helt ..... F28F 19/006 62/298
4,325,594 A * 4/1982 Lang ..... F24F 13/20 312/328
(Continued)

FOREIGN PATENT DOCUMENTS

CN 2420554 Y * 2/2001
CN 108087981 A 5/2018
(Continued)

OTHER PUBLICATIONS

International Search Report issued in International Application No. PCT/MY2021/050002, mailed May 10, 2021.
(Continued)

*Primary Examiner* — Michael G Hoang
*Assistant Examiner* — Frances F. Hamilton
(74) *Attorney, Agent, or Firm* — United IP Counselors, LLC

(57) ABSTRACT

A mounting structure of a grille for mounting the grille onto a device comprises a fixing member having a fixing aperture for receiving a fastening means and a guiding member extending away from the fixing member for inserting into an opening on the device so that the grille is placed in a pre-determined position and the fixing aperture is aligned with a corresponding fastening means receiving slot on the device to facilitate the fastening of the grille onto the device. The fixing member and the guiding member are integrally formed as a single piece on the grille.

5 Claims, 4 Drawing Sheets

(51) Int. Cl.
*F24F 1/56* (2011.01)
*F24F 13/20* (2006.01)

(58) Field of Classification Search
CPC ..... F24F 13/082; F16B 5/0012; F16B 5/0036; F16B 5/0088; F16B 5/0092; F16B 5/0664; F16B 5/064; F04D 29/703
USPC ..... 454/277
See application file for complete search history.

(56) References Cited

U.S. PATENT DOCUMENTS 4,353,680 A * 10/1982 Hiraoka ..... F04D 29/522 415/214.1
5,193,355 A * 3/1993 Matsumi ..... F24F 1/027 62/262
5,251,461 A * 10/1993 Fallows, III ..... F24F 13/08 62/428
5,498,130 A * 3/1996 Wakley ..... F28F 9/002 415/121.2
5,526,553 A * 6/1996 Klein ..... F16B 2/248 24/294
5,575,622 A * 11/1996 Zimmerman ..... F04D 29/703 415/223
5,732,565 A 3/1998 Ramakrishnan et al.
6,082,127 A * 7/2000 Correa ..... F24F 13/20 62/297
2004/0023005 A1* 2/2004 Perez ..... F24F 13/20 428/192
2006/0130516 A1* 6/2006 Sugiyama ..... F24F 1/46 62/298
2008/0188175 A1* 8/2008 Wilkins ..... F24F 13/06 454/347
2010/0319380 A1* 12/2010 Mochizuki ..... F24F 13/20 62/426
2011/0312262 A1* 12/2011 Grandmaison ..... F24F 13/084 454/276
2017/0167519 A1* 6/2017 Anseth ..... F16B 5/07
2019/0219279 A1* 7/2019 Yonehara ..... F24F 1/56
2019/0368753 A1* 12/2019 Kurino ..... F24F 13/084
2020/0049371 A1* 2/2020 Yamaguchi ..... F24F 1/0047
2020/0182510 A1* 6/2020 Nakaya ..... F24F 13/20
2022/0333795 A1* 10/2022 Murakami ..... F24F 1/56
2023/0213217 A1* 7/2023 Yonehara ..... F24F 1/56

FOREIGN PATENT DOCUMENTS

CN 108302617 A 7/2018
CN 208750980 U * 4/2019 ..... F24F 1/0007
CN 208750981 U * 4/2019 ..... F24F 1/0047
JP H0510918 U * 2/1993
JP 3519559 B2 * 4/2004
JP 2014129920 A * 7/2014
JP WO-2018154686 * 11/2019
KR 0130392 B1 4/1998
KR 20010047460 A 6/2001
WO WO-2018179136 A1 * 10/2018 ..... F24F 1/0047
WO WO-2020133910 A1 * 7/2020 ..... F16B 5/0614

OTHER PUBLICATIONS

Written Opinion issued in International Application No. PCT/MY2021/050002, mailed May 10, 2021.
International Preliminary Report on Patentability (Chapter II) issued in International Application No. PCT/MY2021/050002, mailed Dec. 20, 2021.

* cited by examiner

MOUNTING STRUCTURE OF A GRILLE

CROSS-REFERENCE TO RELATED APPLICATION

This application claims priority to International Patent Application No. PCT/MY2021/050002, filed Jan. 18, 2021, entitled "A MOUNTING STRUCTURE OF A GRILLE".

FIELD OF THE INVENTION

The present invention relates to a mounting structure of a grille, particularly a mounting structure for mounting a grille to a device.

BACKGROUND OF THE INVENTION

Air conditioning system can be generally classified into a split air conditioner type and an integrated air conditioner type based on their arrangement and set-up. A split air conditioner has an indoor unit and an outdoor unit that are separated from each other while an integrated air conditioner has an indoor unit and an outdoor unit that are coupled to form a single compact system. The indoor unit is mainly used to exchange heat with indoor air while the outdoor unit is used to exchange heat with outdoor air.

For a split air conditioner type, the indoor unit is typically installed inside a building to be air conditioned while the outdoor unit is installed outside the building in an open space where the surrounding has sufficient air flow to allow heat dissipation during operation. The outdoor unit has an air outlet with a discharge grille at one panel for circulating outdoor air in and out. The grille is necessary for protecting components inside the outdoor unit from being damaged by intrusion of large foreign substances and also for preventing one from being injured by any component working inside the outdoor unit such as a blower fan during operation.

Most of the grilles come with at least a mounting structure respectively for coupling with the panel of the outdoor unit to ensure that the grille is securely fixed onto the outdoor unit. One of the examples is disclosed in KR0130392B1 where a mounting structure is introduced to improve the attachment of a grille onto a panel of an outdoor unit. The grille includes at least two latch members for securely engaging with the coupling holes formed on the panel to secure the grille onto the panel. By having such configuration, it is inconvenient to mount the grille onto the panel as the latch members can be only locked from the internal surface of the panel which is only possible when the panel is disassembled from the outdoor unit, thus the mounting process could be undesirably time-consuming and labor intensive.

Another mounting structure of a grille for the outdoor unit is disclosed in KR20010047460A, where the mounting structure of the grille includes a plurality of elastic coupling members to be coupled with their corresponding holes formed on a panel. Although the elastic coupling members form a resilient mounting structure which can be removed and mounted easily, the elastic material might not be robust to last long as it could subject to deformation or cracking after long exposure to heat and rainwater.

Also, U.S. Pat. No. 5,732,565A discloses a mounting structure for attaching a grille to an air conditioner main body. The mounting structure is formed as a separate device and it is neither integrally connected to the grille nor the main body. Hence, this requires an additional process to securely fix the mounting structure on the main body before the grille is mounted. Further, the coupling of the mounting structure and the corresponding slot of the grille is not efficient as the corresponding slot is hidden from view and is difficult to locate when mounting the grille to the main body. In addition, the coupling is not further tightened by any means and the grille could be easily loosened or even falling out during installation or maintenance. This could be one of the potential safety concerns for installers.

Accordingly, it can be seen in the prior art documents that there exists a need to provide an improved mounting structure of a grille which overcomes the aforesaid problems and shortcomings. The mounting structure shall be made durable, simple and effective for grille assembly and maintenance.

SUMMARY OF THE INVENTION

An objective of the present invention is to provide a mounting structure of a grille with a simple configuration that requires lesser time and work for mounting the grille, thereby facilitating installation and maintenance work.

A further objective of the present invention is to provide a mounting structure of a grille that enables the grille to be placed in a pre-determined position so that the grille is correctly aligned with a device before the grille is fastened onto the device.

Another objective of the present invention is to provide a mounting structure of a grille that allows the grille to be hooked onto a device for support so as to prevent the grille from falling out when in a loosened state.

It is a further objective of the present invention to provide a mounting structure of a grille with high strength and durability.

Accordingly, these objectives shall be achieved by following the teachings of the present invention. The present invention relates to a mounting structure of a grille for mounting the grille onto a device. The mounting structure comprises a fixing member that has a fixing aperture for receiving a fastening means, and a guiding member which extends away from the fixing member. The guiding member is made to be inserted into an opening on the device so that the grille is placed in a pre-determined position while the fixing aperture is aligned with a corresponding fastening means receiving slot on the device to facilitate the fastening of the grille onto the device. The fixing member and the guiding member are integrally formed as a single piece on the grille.

It is preferred that the fixing member is extending from the grille and the guiding member is extending away from the free end of the fixing member. Further, the guiding member is extending substantially horizontally from the free end of the fixing member.

It is further preferred that the guiding member is further inclined downwardly from the fixing member.

In another preferred embodiment of the present invention, the guiding member is curved upwardly from the free end of the fixing member to form an upwardly convex-like shape.

In accordance with another aspect of the present invention, a device comprising a mounting structure of a grille is provided, where the device is preferably an outdoor unit of an air conditioning unit and the grille is preferably a discharge grille of the outdoor unit. The discharge grille is mounted to a front panel of the outdoor unit via the mounting structure. Further, the mounting structure extends from the internal surface of the discharge grille facing the outdoor unit.

BRIEF DESCRIPTION OF THE ACCOMPANYING DRAWINGS

The features of the invention will be more readily understood and appreciated from the following detailed description when read in conjunction with the accompanying drawings of the preferred embodiments of the present invention, in which.

DETAILED DESCRIPTION OF THE PREFERRED EMBODIMENTS

Figure 1:
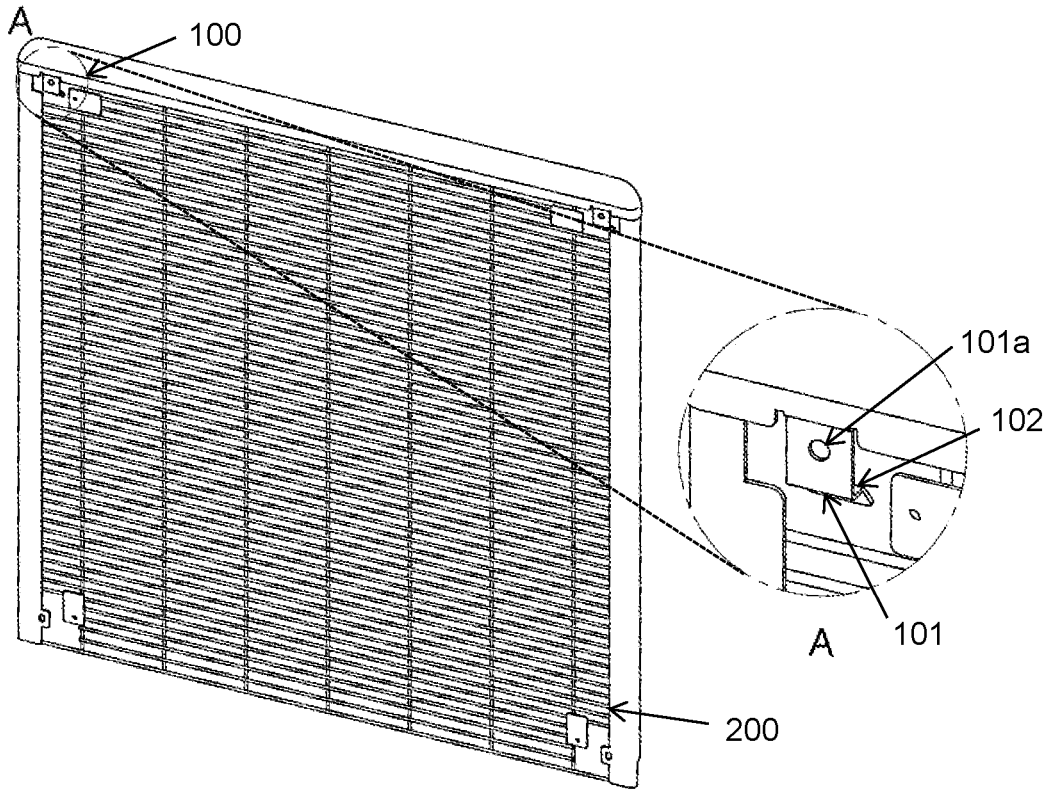
FIG. 1 illustrates a close-up front perspective view of a mounting structure of a grille according to the present invention.

While the present invention is described herein by way of example using embodiments and illustrative drawings, those skilled in the art will recognize that the invention is not limited to the embodiments of drawing or drawings described, and are not intended to represent the scale of the various components. Further, some components that may form a part of the invention may not be illustrated in certain figures, for ease of illustration, and such omissions do not limit the embodiments outlined in any way. It should be understood that the drawings and detailed description thereto are not intended to limit the invention to the particular form disclosed, but on the contrary, the invention is to cover all modifications, equivalents, and alternatives falling within the scope of the present invention as defined by the appended claim. As used throughout this description, the word "may" is used in a permissive sense (i.e. meaning having the potential to), rather than the mandatory sense, (i.e. meaning must). Further, the words "a" or "an" mean "at least one" and the word "plurality" means "more than one" unless otherwise mentioned. Furthermore, the terminology and phraseology used herein is solely used for descriptive purposes and should not be construed as limiting in scope. Language such as "including," "comprising," "having," "containing," or "involving," and variations thereof, is intended to be broad and encompass the subject matter listed thereafter, equivalents, and additional subject matter not recited, and is not intended to exclude other components, integers or steps. Any discussion of documents, acts, articles and the like is included in the specification solely for the purpose of providing a context for the present invention. It is not suggested or represented that any or all of these matters form part of the prior art base or were common general knowledge in the field relevant to the present invention.

The present invention is described hereinafter by various embodiments with reference to the accompanying drawings, wherein reference numerals used in the accompanying drawings correspond to the like elements throughout the description. This invention may, however, be embodied in many different forms and should not be construed as limited to the embodiment set forth herein. Rather, the embodiment is provided so that this disclosure will be thorough and complete and will fully convey the scope of the invention to those skilled in the art.

The present invention relates to a mounting structure (100) of a grille (200) for mounting the grille (200) onto a device. The mounting structure (100) is made to ease installation of the grille (200) in which a guiding member (102) is integrated with a fixing member (101) to enable the grille (200) to be disposed in a predetermined position and also to ensure the grille (200) correctly aligned with the device before the grille (200) is fastened onto the device, thereby reducing time and labor required.

Referring to the drawings shown in FIGS. 1 to 5, the invention will now be described in more detail.

Figure 2:
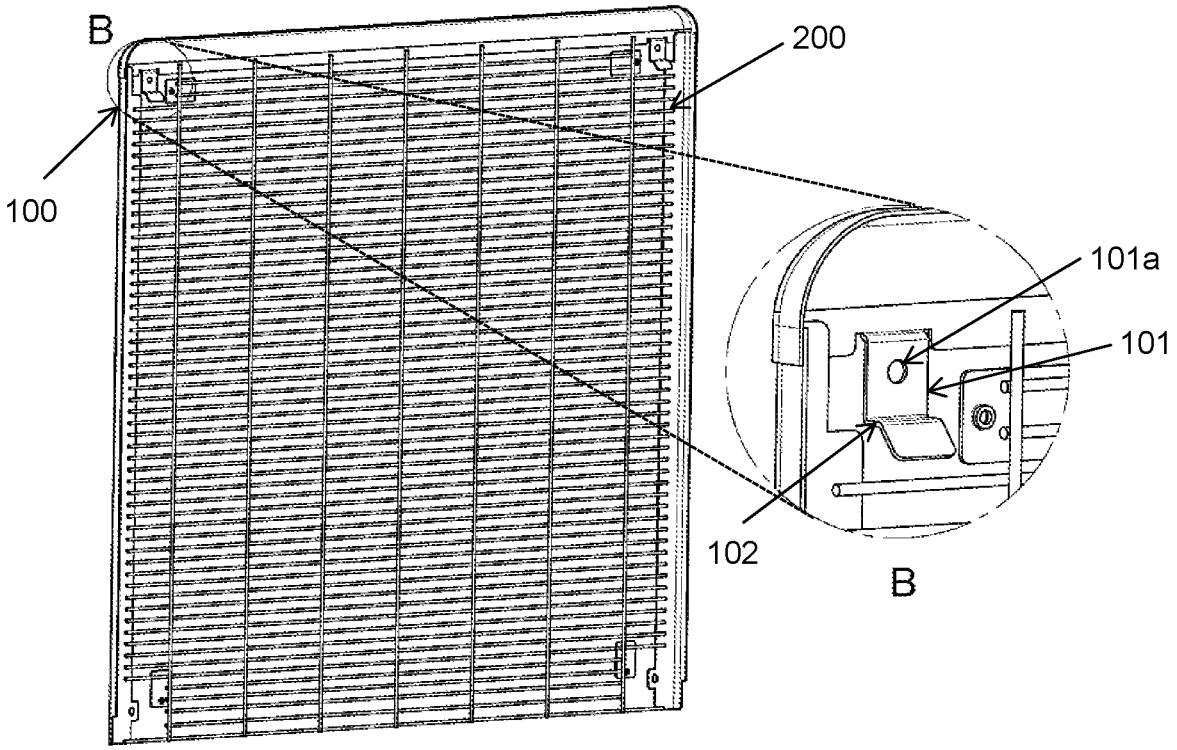
FIG. 2 illustrates a close-up back perspective view of a mounting structure of a grille according to the present invention.

FIGS. 1 and 2 illustrate close-up front and back perspective views of the mounting structure (100) of the grille (200) according to the present invention. The grille (200) preferably has at least two mounting structures (100) disposed near to the top right and top left corners of the frame of the grille (200) respectively, but it is not limited to this configuration. The mounting structure (100) could be arranged in other applicable manner or in any appropriate number. Further, the grille (200) comprises two fastening means receiving slots disposed near to the bottom right and bottom left corners of the frame of the grille (200) respectively so as to further secure the grille (200) onto the device.

In a preferred embodiment of the present invention, the mounting structure (100) comprises a fixing member (101) extending from the grille (200). The fixing member (101) preferably has a fixing aperture (101*a*) for receiving a fastening means. Further, the mounting structure (100) preferably comprises a guiding member (102) extending away from the fixing member (101). The guiding member (102) is made to be inserted into an opening formed on the device so that the grille (200) is placed at a predetermined position and the fixing aperture (101*a*) is aligned with a corresponding fastening means receiving slot adjacent to the opening on the device to facilitate the fastening of the grille (200) onto the device.

In a preferred embodiment of the present invention, the fixing member (101) and the guiding member (102) are integrally formed as a single piece on the grille (200). The fixing member (101) has one end extended from the grille (200) and the guiding member (102) is extending away in a different plane from the free end of the fixing member (101).

In a preferred embodiment of the present invention, the guiding member (102) is extending substantially horizontally from the free end of the fixing member (101). With reference to FIG. 2, the fixing member (101) is preferably extending substantially vertically from the frame of the grille (200) and the guiding member (102) is disposed to extend substantially perpendicular to the fixing member (101). The guiding member (102) is inserted into the opening formed on the device to mount the grille (200) onto the device.

In another embodiment of the present invention, the guiding member (102) may not be necessarily extending substantially perpendicular to the fixing member (101). The guiding member (102) could be possibly inclined upwardly from the free end of the fixing member (101).

The guiding member (102) is preferably further inclined downwardly, in particular the guiding member (102) which extends substantially horizontally or inclines upwardly could further extend downwardly. As illustrated in FIG. 2, the extended portion of the guiding member (102) is further bent downwardly to form a hook-like configuration, thereby allowing the grille (200) to hook onto the device. Therefore, the guiding member (102) could be prevented from slipping out and the grille (200) will not fall out of the device easily even when the fastening means is removed.

In another embodiment of the present invention, the guiding member (102) could be curved upwardly from the free end of the fixing member (101) to form an upwardly convex-like shape. The guiding member (102) may serve as a hook-like structure to enable the grille (200) hooking onto the device so as to prevent the grille (200) from being easily detached from the device.

Figure 3:
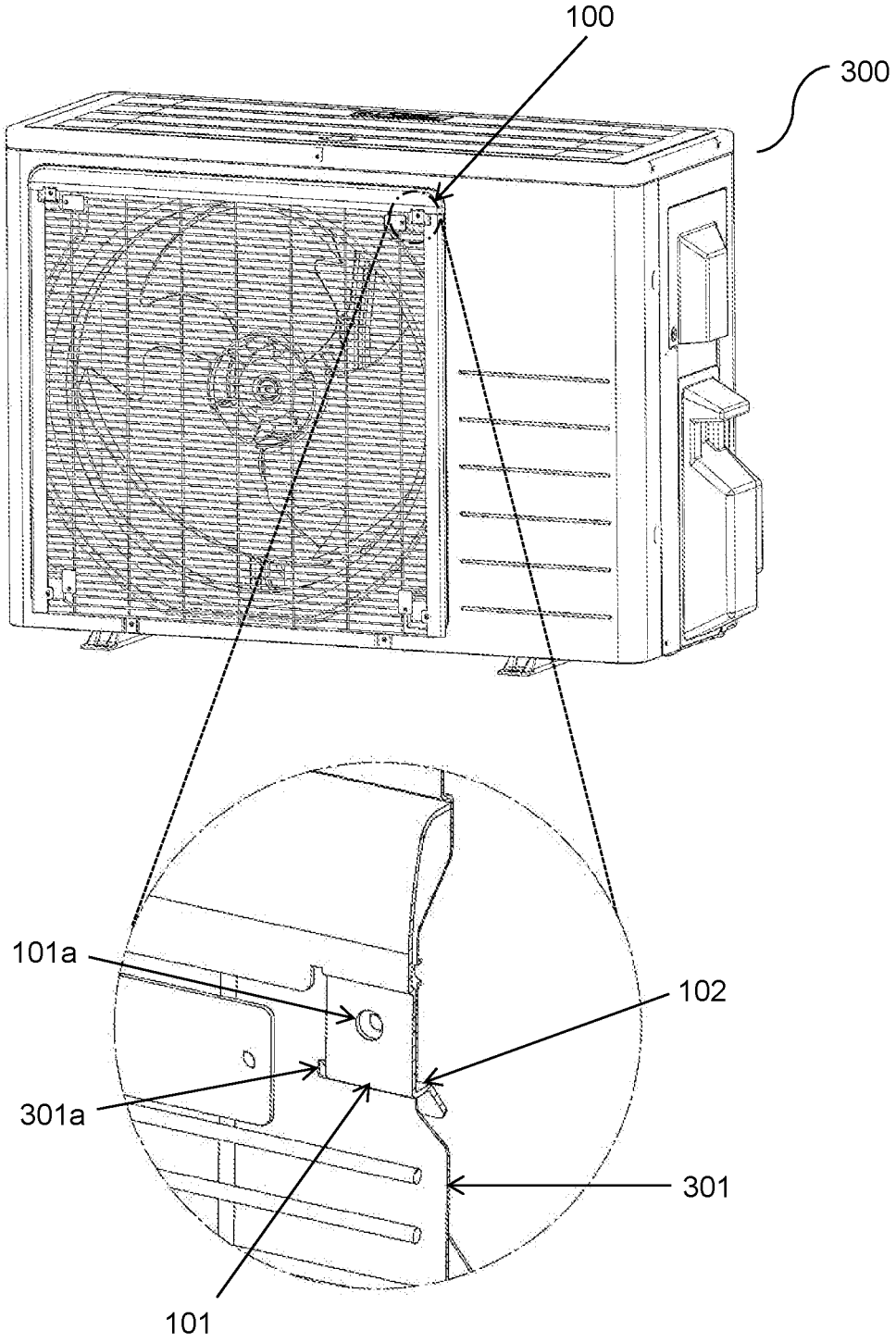
FIG. 3 illustrates a close-up front perspective view showing the mounting of a discharge grille having the mounting structure of the present invention onto a front panel of an air conditioner outdoor unit according to a preferred embodiment of the present invention.

With reference to FIG. 3, the device is preferably an outdoor unit (300) of an air conditioning unit equipped with a front panel (301) and a grille (200). The grille (200) is preferably a discharge grille (400) of the outdoor unit (300). The front panel (301) is generally provided with an air outlet to discharge heat-exchanged air from the outdoor unit (300). The air outlet is usually provided with the discharge grille (400) to avoid foreign substances from entering and damaging the components inside the outdoor unit (300), such as the blower fan. The discharge grille (400) is mounted onto the front panel (301) of the outdoor unit (300) via the aforedescribed mounting structure (100) according to the preferred embodiment of the present invention.

The mounting structure (100) of the present invention preferably extends from the internal surface of the discharge grille (400) which is facing the outdoor unit (300), where the guiding member (102) extends from the fixing member (101) towards the direction facing the outdoor unit (300). The front panel (301) of the outdoor unit (300) comprises an opening 301*a* for receiving the guiding member (102) to fit the discharge grille (400) onto the front panel (301) so that the front panel (301) could support the discharge grille (400) during installation or removal of the discharge grille (400). Further, a fastening means receiving slot is formed on the front panel (301) of the outdoor unit (300) at a position corresponding to the fixing aperture (101*a*) of the mounting structure (100) for receiving the conventional fastening means that is used for securing the discharge grille (400) onto the front panel (301).

Figure 4:
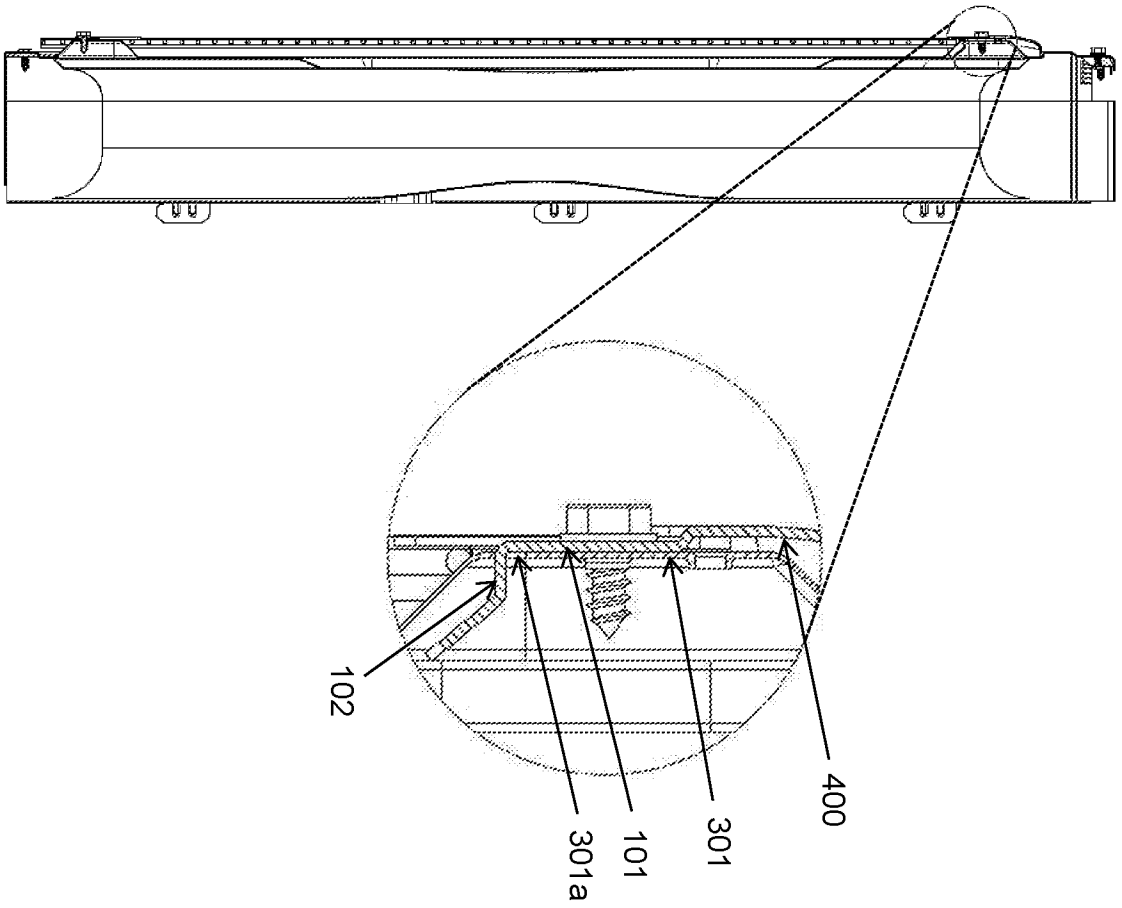
FIG. 4 illustrates a close-up cross-sectional side view showing a discharge grille mounted to a front panel of an air conditioner outdoor unit via a mounting structure according to a preferred embodiment of the present invention.
Figure 5:
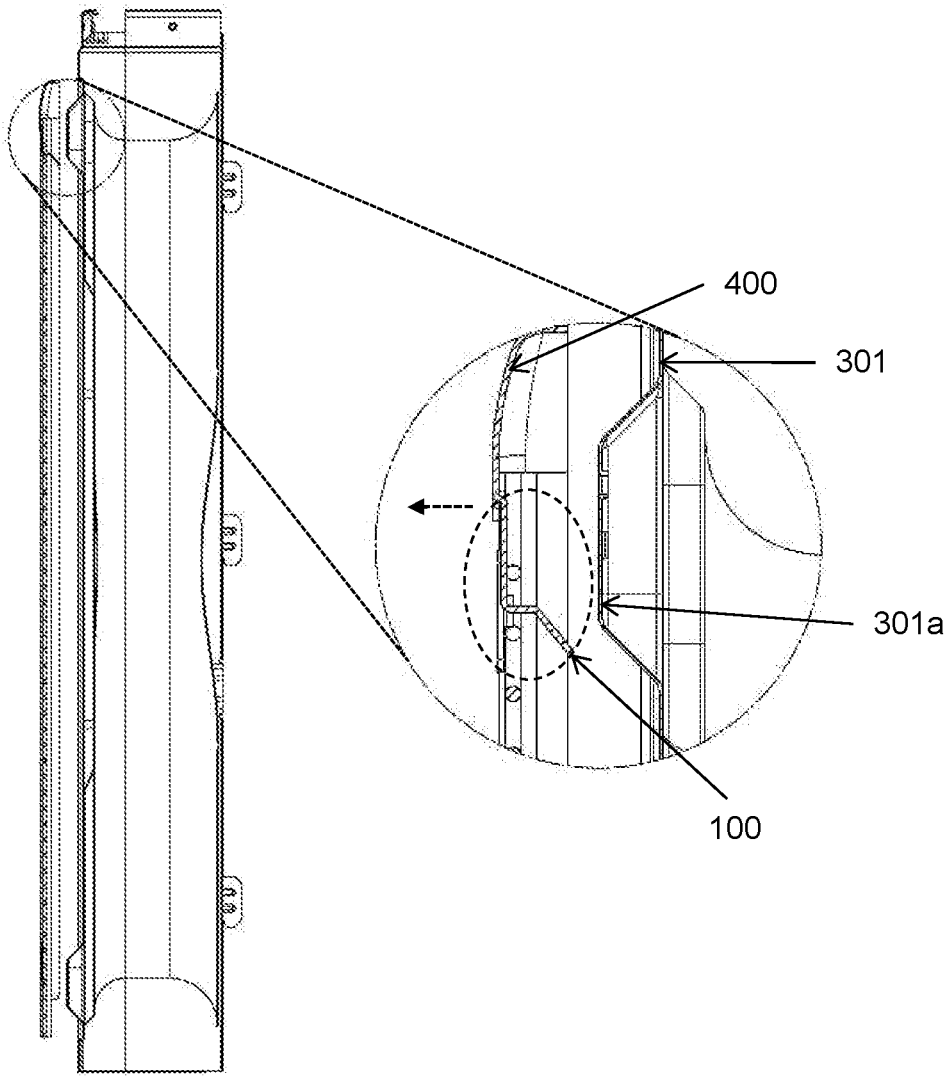
FIG. 5 illustrates a close-up cross-sectional side view showing a discharge grille dismounted from a front panel of an air conditioner outdoor unit via a mounting structure according to a preferred embodiment of the present invention.

As illustrated in FIG. 4, the guiding member (102) is inserted into the corresponding opening 301*a* on the front panel (301) during installation. The guiding member (102) is constructed in a hook-like configuration so that the discharge grille (400) could hook onto the front panel (301) and maintain in a predetermined position. At the same time, the fixing aperture (101*a*) could be correctly aligned with the corresponding fastening means receiving slot on the front panel (301) so as to facilitate the fastening of the discharge grille (400) onto the front panel (301). On the other hand, when the discharge grille (400) is dismounted from the front panel (301) as illustrated in FIG. 5, the screw is unfastened to loosen the discharge grille (400). The discharge grille (400) will remain hooked on the front panel (301) until the guiding member (102) disengages from the corresponding opening.

The mounting structure (100) of a grille (200) according to the present invention provides a number of advantages over the existing mounting structure. Firstly, the mounting structure (100) of the present invention aims to provide a convenient way of mounting a grille (200) without disassembling any parts of an outdoor unit (300). Also, the mounting structure (100) is integrated with a guiding member (102) that has a hook-like configuration for ease of installation. Once the grille (200) is hooked on the panel, the fixing aperture (101*a*) will be substantially aligned with a corresponding fastening means receiving slot of the panel so as to speed up the installation. The hooked grille (200) will not fall down easily even when the fastening means such as screws have yet been fastened onto the grille (200), hence any accidental injuries that may be caused by the loosened grille (200) could be minimised or even avoided during installation and maintenance. Furthermore, the mounting structure (100) will not easily deform after a long period of usage.

The exemplary implementation described above is illustrated with specific shapes, dimensions, and other characteristics, but the scope of the invention also includes various other shapes, dimensions, and characteristics. For example, the position of the mounting structure (100) could be modified to adapt to any appropriate particular combination of various parts of the grille (200). Also, rather than the materials mentioned above, the components of the mounting structure (100) may be made of other materials having similar and/or enhanced properties.

Various modifications to these embodiments are apparent to those skilled in the art from the description and the accompanying drawings. The principles associated with the various embodiments described herein may be applied to other embodiments. Therefore, the description is not intended to be limited to the embodiments shown along with the accompanying drawings but is to be providing broadest scope of consistent with the principles and the novel features disclosed or suggested herein. Accordingly, the invention is anticipated to hold on to all other such alternatives, modifications, and variations that fall within the scope of the present invention and appended claims.

The invention claimed is:

1. A grille configured to be attached to a front panel of an air-conditioning device, the front panel having an opening and a fastener-receiving slot spaced apart from but in proximity to the opening, the grille being essentially flat and comprising:

a grille frame; and a mounting structure, the mounting structure including:

a fixing-member and a guiding-member integrally formed as a single piece:

the fixing-member is offset inwardly from, and parallel to, the grille frame;

the fixing-member comprising a fixing aperture, and the guiding-member comprising a substantially horizontal portion extending inwardly from the fixing-member, and an extended portion bent downwardly from the substantially horizontal portion of the guiding-member;

wherein the mounting structure is configured and arranged such that, when the grille is attached to the front panel of the device, the mounting structure extends into the panel opening to allow the grille to hook into the front panel such that the fastener-receiving slot of the front panel is aligned with the fixing aperture of the mounting structure.

2. An air-conditioning device, comprising:

a vertical panel having an air outlet, an opening, and a fastener-receiving slot spaced apart from but in proximity to the opening; and a flat grille configured to be attached to the panel and overlying the panel air outlet, wherein the grille comprises:

a grille frame; and a mounting structure, the mounting structure including a fixing-member and a guiding-member integrally formed as a single piece, the fixing-member is offset inwardly towards the panel, and extending downwardly from the grille frame;

wherein the fixing member comprising a fixing aperture;

the guiding-member comprising a substantially horizontal portion extending inwardly from the fixing-member and an extended portion bent downwardly from the substantially horizontal portion of the guiding-member;

wherein the mounting structure is configured and arranged such that, when the grille is attached to the panel of the device, the mounting structure extends into the panel to allow the grille to hook into the panel such that the fastener-receiving slot of the panel is aligned with the fixing aperture of the mounting structure, and wherein the grille is secured to the panel by a fastener passing through the fixing aperture and into the fastener-receiving slot of the panel.

3. The device according to claim 2, wherein the air-conditioning device is a heat-dissipating outdoor unit of an air-conditioning apparatus.

4. The device according to claim 3, wherein the grille is a discharge grille of the outdoor unit.

5. The device according to claim 4, wherein the vertical panel to which the grille is secured is a front panel of the outdoor unit.

* * * * *